US005445751A

United States Patent [19]

Kanzaki et al.

[11] Patent Number: 5,445,751

[45] Date of Patent: Aug. 29, 1995

[54] FLUOROSILICONE LUBRICANT COMPOSITIONS

[75] Inventors: Yasue Kanzaki; Hideki Kobayashi; Toru Masatomi; Ichiro Murakami, all of Chiba, Japan

[73] Assignee: Dow Corning Toray Silicon Co., Ltd., Tokyo, Japan

[21] Appl. No.: 187,241

[22] Filed: Jan. 26, 1994

[30] Foreign Application Priority Data

Mar. 3, 1993 [JP] Japan ..... 5-067535
Mar. 8, 1993 [JP] Japan ..... 5-073003

[51] Int. Cl.[6] ..... C10M 107/50
[52] U.S. Cl. ..... 252/49.6; 252/78.3
[58] Field of Search ..... 252/49.6

[56] References Cited

U.S. PATENT DOCUMENTS

| | | | |
|---|---|---|---|
| 3,529,003 | 9/1970 | Rausch et al. | 252/49.6 |
| 3,642,626 | 2/1972 | Christian | 252/33.6 |
| 3,702,823 | 11/1972 | Kim | 252/49.6 |
| 4,070,343 | 1/1978 | Kishimoto et al. | 260/45.75 F |
| 4,256,806 | 3/1981 | Snyder | 428/378 |
| 4,324,671 | 4/1982 | Christian et al. | 252/49.6 |
| 4,515,702 | 5/1985 | Mori et al. | 252/49.6 |
| 4,537,691 | 8/1985 | Mori et al. | 252/49.6 |
| 4,549,004 | 10/1985 | von Au et al. | 252/49.6 |
| 4,828,739 | 5/1989 | Satoh et al. | 252/49.6 |
| 5,217,633 | 6/1993 | Steinbach et al. | 252/49.6 |

FOREIGN PATENT DOCUMENTS

| | | |
|---|---|---|
| 51-041046 | 5/1976 | Japan . |
| 49460 | 9/1979 | Japan . |
| 60-163966 | 8/1985 | Japan . |
| 190290 | 8/1987 | Japan . |
| 1306478 | 6/1989 | Japan . |
| 03143997 | 6/1991 | Japan . |

*Primary Examiner*—Ellen M. McAvoy
*Attorney, Agent, or Firm*—Robert Spector

[57] ABSTRACT

Fluorosilicone lubricants comprise (A) a linear and/or cyclic polydiorganosiloxane containing at least one silicon-bonded perfluoroalkylethyl radical with at least four perfluorinated carbon atoms, and an additive selected from 1) heat stabilizers that are reaction products of cerium compounds and alkali metal silanolates or organopolysiloxanes with aminophenyl or naphthylaminophenoxy groups and 2) powdered fluororesins as cold temperature additives.

3 Claims, No Drawings

FLUOROSILICONE LUBRICANT COMPOSITIONS

BACKGROUND OF THE INVENTION

1. Field of the Invention

This invention relates to fluorosilicone lubricant compositions. More particularly, this invention relates to fluorosilicone lubricants exhibiting excellent lubricating properties in addition to a high level of resistance to heat or cold.

2. Background Information

Silicone lubricants based on dimethylsilicone oil or methylphenylsilicone oil have a resistance to heat and cold in addition to friction properties that are superior to those of organic oil-based lubricants. For example, the dynamic coefficient of friction for dimethylsilicone oil-based silicone lubricants is 0.2 For these reasons silicone lubricants are used in a variety of applications.

The last few years have seen a number of proposals with regard to the blending of heat stabilizers into the these silicone lubricants for the purpose of improving their heat resistance. Thus, for example, Japanese Patent Application Laid Open [Kokai or Unexamined] No. Sho 51-41046 [41,046/1976 ] teaches adding the reaction product obtained from cerium chloride and an alkali metal silanolate that contains at least 3 organosiloxane units, while Japanese Laid Open Patent application No. Sho 60-106891 [106,891/1985] proposes the addition of an organopolysiloxane containing the anilinophenoxy or naphthylaminophenoxy group.

On the other hand, fluorosilicone lubricants based on 3,3,3-trifluoropropyl-containing silicone oils have a solvent resistance and boundary lubricating characteristics superior to those of the heretofore known silicone lubricants and as a result are used as lubricants in specialty applications.

However, the above-described fluorosilicone lubricants have a poor heat resistance. Thus, when subjected to use at elevated temperatures, the 3,3,3-trifluoropropyl-containing silicone oil depolymerizes, resulting in a substantial deterioration in the lubricating properties of this type of fluorosilicone lubricant. In response to this, Japanese patent application Laid Open No. Hei 3-143997 [143,997/1991] discloses a fluorosilicone lubricant that consists of 3,3,3-trifluoropropyl-containing silicone oil and the anilinophenoxy(or naphthyl aminophenoxy)-containing organopolysiloxane proposed in Japanese Patent Application Laid Open Number Sho 60-106891.

The fluorosilicone lubricant proposed in Japanese Patent Application Laid Open Number Hei 3-143997 still has an unsatisfactory heat resistance. Moreover, the heat resistance also remains inadequate in the case of fluorosilicone lubricant consisting of 3,3,3-trifluoropropyl- containing silicone oil and he reaction product proposed in Japanese Pa-tent Application Laid Open No. Sho 51-41046.

With the goal of further improving the lubricating properties of silicone lubricants, a number of silicone lubricants thickened with fluororesin powder (e.g., polytetrafluoroethylene powder, etc.) have been proposed over the course of the last few years (Japanese Patent Application Laid Open [Kokai or Unexamined] Nos. Sho 54-163277 [163,277/1979], Sho 54-49460 [49,460/1979 ], Sho 57-34135 [34,135/1982], and Sho 62-190290 [190,290/1987]).

Fluorosilicone lubricants composed of this type of silicone oil and a thickener have an excellent oil resistance, excellent load-bearing capacity at heavy loads, and excellent boundary lubrication properties. A disadvantage of these fluorosilicone lubricants is their poor resistance to cold temperatures. Thus, they suffer from a substantial deterioration in lubricating performance when used at these temperatures, which prevents their use at low temperatures to lubricate machine elements sliding at high speeds.

One objective of this invention define a class of silicone lubricants that exhibit an excellent resistance to either heat or cold and excellent lubricating properties.

SUMMARY OF THE INVENTION

The objectives of the present invention are achieved by the combination of 1) a linear or cyclic fluorinated diorganosiloxanes wherein the fluorinated hydrocarbon radicals are perfluoroalkylethyl radicals containing at least four perfluorinated carbon atoms with a member selected from the group consisting of 2) heat stabilizers selected from the group consisting of a) reaction products of a cerium compound and an alkali metal silanolate containing at least three organosiloxane units, and b) organopolysiloxanes containing at least one anilinophenoxy or naphthylaminophenoxy group and 3) powdered fluororesins as fillers to achieve the consistency of a grease while maintaining lubrication properties at low temperatures.

DETAILED DESCRIPTION OF THE INVENTION

The present invention relates to a fluorosilicone lubricant comprising (A) 100 parts by weight of a fluorosilicone oil exhibiting a general formula selected from the group consisting of

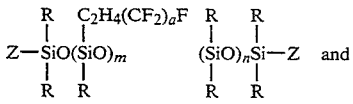

and

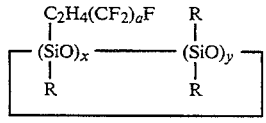

where R represents a monovalent hydrocarbon radical, Z represents a monovalent hydrocarbon radical or a perfluoroalkylethyl radical with the general formula $-C_2H_4(CF_2)_aF$, a is an integer with a value of at least 4, m is zero or a positive integer, n is zero or a positive integer, and the sum of m+n is from zero to 1,000, with the proviso that when m is zero, at least one of the z groups represents said perfluoroalkylethyl radical, x is a positive integer, y is zero or a positive integer, and the sum of x+y is at least 3;

and an additive selected from the group consisting of (B) 0.01 to 10 weight parts of at least one heat stabilizer that is in turn selected from the group consisting of (1) reaction products of a cerium compound and an alkali metal silanolate containing at least 3 organosiloxane units, and (2) organopolysiloxanes containing in each molecule at least one anilinophenoxy or naphthylaminophenoxy group; and (C) from 1 to 100 parts of a powdered fluororesin.

The fluorosilicone oil that constitutes ingredient A of the present lubricant compositions is the base on principal ingredient of these compositions and is a linear diorganopolysiloxane represented by general formula I

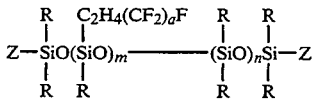

I

Ingredient A contains perfluoroalkylethyl radicals at terminal and/or non-terminal positions. In formula I R represents a monovalent hydrocarbon radical that includes but is not limited to alkyl radicals such as methyl, ethyl, propyl, and butyl; alkenyl radicals such as vinyl, allyl, butenyl, pentenyl and hexenyl; aryl radicals such as phenyl, tolyl, xylyl and naphthyl; and aralkyl radicals such as benzyl and phenethyl.

The substituent represented by Z is a monovalent hydrocarbon radical or a perfluoroalkylethyl radical with the general formula $-C_2H_4(CF_2)_aF$ in which the subscript a is an integer with a value of at least 4. The monovalent hydrocarbon radicals represented by Z are selected from the same group as those represented by R.

The perfluoroalkylethyl radicals that can be represented by Z are specifically exemplified by those radicals in which a is from 4 to 8. m in the preceding formula is zero or a positive integer and n is zero or a positive integer. Also, the sum of m+n is all integer with a value of zero to 1,000. Values for m+n in excess of 1,000 yield a fluorosilicone oil with an excessively high viscosity that adversely affects use of the oil as a lubricant.

When m zero, at least one of the groups represented by Z must be a perfluoroalkylethyl radical with the general formula $-C_2H_4(CF_2)_aF$, in which a is an integer with a value of at least 4, preferably from 4 to 8.

The viscosity of ingredient A is not specifically restricted, but is preferably from 10 to 10,000 centipoise (0.01 to 10 Pa.s).

Linear fluorosilicone oils are exemplified by diorganosiloxanes of the general formula Ia, which contain perfluoroalkylethyl radicals at both molecular chain terminals:

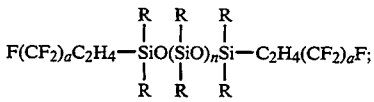

Ia diorganosiloxanes of the general formula Ib, which contain perfluoroalkylethyl radicals bonded to non-terminal silicon atoms:

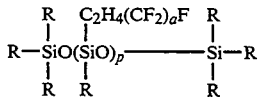

Ib and by diorganosiloxane copolymers of the general formula Ic, which contain perfluoroalkylethyl radicals bonded to non-terminal silicon atoms

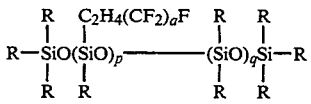

Ic where R and a are as previously defined, and p and q are positive integers.

The method for synthesizing diorganosiloxanes corresponding to general formula I is not particularly restricted. Suitable methods include but are not limited to the 1) hydrolysis of perfluoroalkylethylorganodichlorosilanes or cohydrolysis of a perfluoroalkylethylorganodichlorosilane and a non-fluorinated diorganodichlorosilane and 2) reaction of the resulting hydrolyzate with a triorganochlorosilane or a hexaorganodisilazane; polymerization of a perfluoroalkylethyldiorganosiloxy-terminated linear fluorosilicone oil with a cyclic diorganosiloxane in the presence of basic catalyst; reaction of a perfluoroalkylethylorganodichlorosilane with zinc oxide in an organic solvent to yield a hydroxydiorganosiloxy-terminated perfluoroalkylethylorganopolysiloxane and subsequent reaction of this organopolysiloxane with triorganochlorosilane or hexaorganodisilazane; cohydrolysis of a perfluoroalkylethylorganodichlorosilane and a diorganodichlorosilane and subsequent reaction of the hydrolyzate with a perfluoroalkylethyldiorganochlorosilane or a 1,3-di (perfluoroalkylethyl) tetraorganodisilazane; and copolymerization of a cyclic perfluoroalkylethyl-organosiloxane, a cyclic diorganosiloxane, and a 1,3-di(perfluoroalkylethyl)tetraorganodisiloxane in the presence of a basic catalyst.

Alternatively, the fluorinated organosiloxanes used as ingredient A of the present compositions can be cyclic diorganosiloxanes corresponding to the general formula II.

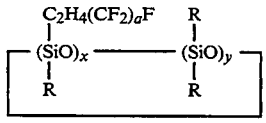

II

The substituent represented by R in formula II is selected from the same group of monovalent hydrocarbon radicals represented by R in formula I. The subscript a in formula II is an integer with a value of at least 4, preferably from 4 to 8.

The subscript x in formula II is a positive integer, y is zero or a positive integer, and x+y is an integer with a value of at least 3, and preferably from 3 to 30. Cyclic organosiloxanes in which the sum of x+y is less than 3 do not exist, while the synthesis of cyclic organosiloxanes in which x+y exceeds 30 is quite difficult.

Cyclic diorganosiloxanes in which the sum x+y is from 3 to 30 are typically produced as a by-product during preparation of the straight-chain polyorganosiloxane represented by formula I. No specific restrictions apply to the viscosity of cyclic diorganosiloxanes of formula II in the fluorosilicone lubricant of the present invention; however their viscosity is preferably from 10 to 10,000 centipoise (0.1 to 10 Pa.s).

The method for synthesizing cyclic fluorinated organosiloxanes corresponding to formula II is not particularly restricted. Suitable methods include the hydrolysis of a perfluoroalkylethylorganodichlorosilane; the cyclization of a hydroxydiorganosiloxy-terminated perfluoroalkylethylorganopolysiloxane in the presence of basic catalyst; the cohydrolysis of a perfluoroalkylethylorganodichlorosilane and a diorganodichlorosilane; and the cyclization of hydroxydiorganosiloxy -terminated perfluoroalkylethylorganosiloxanediorganosiloxane copolymers in the presence of a basic catalyst.

Ingredient B of the present fluorosilicone lubricant compositions imparts heat stability to the fluorosilicone oil referred to as ingredient A. The two alternatives for ingredient B are reaction products obtained from a cerium compound and alkali metal silanolate that contains at least 3 organosiloxane units, referred to as ingredient B1, and/or organopolysiloxanes containing at least 1 anilinophenoxy or naphthylaminophenoxy group in each molecule, referred to as ingredient B2.

Ingredient B1 is the reaction product obtained from a cerium compound and alkali metal silanolate that contains at least 3 organosiloxane units. The alkali metal silanolate is not specifically restricted and is exemplified by potassium, sodium, and cesium silanolates.

Alkali metal silanolates that can be used to prepare ingredient B1 can be synthesized by known methods. The silicon-bonded hydrocarbon radicals in the organosiloxane units of this ingredient are not particularly restricted. Suitable hydrocarbon radicals include but are not limited to alkyl radicals such as methyl, ethyl, propyl and butyl; alkenyl radicals such as vinyl, allyl, butenyl, pentenyl, and hexenyl; aryl radicals such as phenyl, tolyl, xylyl, and naphthyl; aralkyl groups such as benzyl and phenethyl; and perfluoroalkylethyl radicals with the general formula $—C_2H_4(CF_2)_aF$, in which a is an integer with a value of at least 4. At least one of the silicon-bonded organic groups in ingredient B1 is a perfluoroalkylethyl radical when ingredient A has a high concentration of perfluoroalkylethyl radicals of the same general formula.

The cerium compound used to prepare ingredient B1 is also not particularly restricted. Suitable cerium compounds include but are not limited to cerium halides such as cerium crystalline chloride heptahydrate, cerium chloride decahydrate, high-purity cerium chloride, and cerium fluoride; cerium carboxylates such as cerium oxalate, cerium acetate, cerium 2-ethylhexanoate, and cerium naphthenate; and chelated cerium compounds such as cerium acetylacetonate. Crystalline cerium chloride heptahydrate is preferred because of its availability.

The alkali metal silanolate/cerium compound reaction product can be prepared by mixing and/or reacting equimolar quantities of these two ingredients substances and filtering off the salt produced as a by-product.

This reaction is preferably conducted using the anhydrous cerium compound obtained from an appropriate dehydration treatment. Organic solvents suitable for this reaction include but are not limited to aliphatic solvents such as hexane, heptane; cycloaliphatic solvents such as cyclohexane and cycloheptane; alcohol solvents such as methanol, ethanol and isopropanol; and aromatic solvents such as toluene and xylene. The temperature for this reaction is not specifically restricted and ranges from room temperature to the reflux temperature of the solvent. This reaction is accelerated by heating.

Ingredient B2 of the present compositions is an organopolysiloxane containing at least 1 anilinophenoxy group or naphthylaminophenoxy group per molecule. No specific restriction applies to the location of the anilinophenoxy or naphthylaminophenoxy group within the organopolysiloxane molecule. These groups can be located at the terminal and/or non-terminal positions. The silicon-bonded organic groups other than the anilinophenoxy group or naphthylaminophenoxy group in ingredient B2 are not particularly restricted. These additional groups can be any of the monovalent hydrocarbon radicals defined for R of ingredient A. In addition, the R can represent a perfluoroalkylethyl radical of the general formula $$—C_2H_4(CF_2)_aF$$

where a is an integer with a value of at least 4. It is preferred that at least one of the silicon-bonded organic groups in ingredient B2 be one of these perfluoroalkylethyl radicals when the silicon-bonded organic groups in ingredient A have a high concentration of perfluoroalkylethyl radicals with the same general formula.

The molecular structure of ingredient B2 is not specifically restricted, and it is exemplified by straight chain, cyclic, branched chain, and partially branched straight chain. Straight chain structures are, however, preferred.

The method for synthesizing ingredient B2 is also not particularly restricted. Suitable methods include but are not limited to the reaction of p-anilinophenol or a naphthylaminophenol with an acyloxy-functional polyorganosiloxane and the reaction of p-anilinophenol or naphthylaminophenol with a polyorganosiloxane containing a silicon-bonded chlorine atom in the presence of a hydrogen chloride acceptor.

Ingredient B1 and/or B2 is blended with the fluorosilicone lubricants of the present invention at a total concentration of from 0.01 to 10 parts by weight of these ingredients per 100 weight parts of ingredient A. When the combined weights of ingredients B1 and B2 totals less than 0.01 weight part per 100 weight parts of ingredient A, the resulting fluorosilicone lubricant will have a poor heat resistance. When the combined weights of ingredients B1 and B2 is greater than 10 weight parts per 100 weight parts of ingredient A, the resulting fluorosilicone lubricant will exhibit poor lubricating characteristics.

Ingredient C of the present compositions is a fluororesin powder which functions as a thickener and enables the resultant grease to retain its lubricating properties at cold temperatures, typically below 0° C., and preferably at about −45° C. No specific restrictions apply to the type of fluororesin powder comprising ingredient C. Fluororesins suitable for use as ingredient C include but are not limited to polytetrafluoroethylene, tetrafluoroethylene/ethylene copolymers, hexafluoropropylene/ethylene copolymers, chlorotrifluoroethylene/ ethylene copolymers, perfluoroalkylvinyl ether/ethylene copolymers, perfluoroalkoxyalkylvinyl ether/ethylene copolymers, trifluoroethylene/ethylene copolymers, and perfluoroalkylethylene/ethylene copolymers.

The morphology or shape of the fluororesin particles comprising ingredient C is also not specifically restricted, and include spherical, ovoid, and cylindrical particles, flakes, whiskers, and fibers. While the average particle size of ingredient C is not specifically restricted, fluororesin particles with average particle sizes in the range of from 0.05 to 100 micrometers are preferred.

When the present lubricants contain ingredient C the concentration of this ingredient is from 1 to 100 weight parts per 100 weight parts of ingredient A. The lubricating properties of the resulting fluorosilicone lubricant decline when ingredient C is present at less than 1 weight part per 100 weight parts of ingredient A. In addition, such lubricants are no longer greases.

When the concentration of ingredient C exceeds 100 weight parts per 100 weight parts of ingredient A, the lubricating properties of the resultant fluorosilicone lubricant again decline and such lubricants again are no longer greases.

The combination of ingredients A and C gives the present compositions the consistency of a grease and enables the compositions to retain their lubricating properties at temperatures below about 25° C.

Any of the present compositions can contain conventional lubricant additives so long as these additives do not compromise the objectives of the present invention. Additives that can be present in the lubricant compositions of this invention include but are not limited to corrosion inhibitors; foam control agents; extreme-pressure agents such as sulfurized olefins, and sulfurized oils; wear inhibitors such as phosphite esters, phosphate esters, the amine salts of phosphate esters, zinc thiophosphate, and sulfurized molybdenum dithiocarbamate; antioxidants such as phenol compounds, diarylamine compounds; and colorants.

The fluorosilicone lubricants of this invention are prepared simply by mixing ingredient A with at least one of ingredients B1 and B2, or with ingredient C. Suitable equipment for mixing the ingredients of the present compositions to homogeneity include but is not limited to kneader mixers, Ross mixers, homogenizers, Henschel mixers, colloid mills, and three-roll mills.

In some cases it will be advantageous to mix ingredient A with B1 and/or B2 or with ingredient C under an inert gas atmosphere such as nitrogen.

Fluorosilicone lubricant compositions of the present invention containing ingredient B1 and/or B2 are highly heat-resistant, have excellent lubricating properties, and also excellent boundary lubricating characteristics. These compositions can therefore be used as a lubricant for sliding machine parts at high temperatures or high speeds.

Fluorosilicone greases prepared by blending ingredients A and C can be used as low-temperature lubricants because these greases have both an excellent cold resistance and excellent lubricating properties. Moreover, because these greases have excellent boundary lubrication characteristics and an excellent load-bearing capacity at heavy loads, they can be used as a lubricant for machine parts sliding at high speeds in cold temperature environments.

EXAMPLES

The following examples describe preferred embodiments of the present lubricant compositions and compare the properties of these compositions with prior art compositions. The examples should not be interpreted as limiting the invention defined in the accompanying claims. In the examples, the values reported for the viscosity and lubrication were measured at 25° C.

Heat-Resistance Test

The lubricant was held in a hot-air circulation oven at 200° C. for 100 or 200 hours and its viscosity was then measured. The percent change in the viscosity of the heat-treated lubricant from that of the untreated lubricant was determined and used as the heat-resistance index.

Lubrication Test

As a measure of the lubricating characteristics of the lubricant, the dynamic coefficient of friction (f) was measured using a Soda pendulum oiliness and friction tester (from Shinko Engineering Company, Limited) under standard test conditions (a total loading of 0.297 kg; a unit test piece vertical loading of 0. 105 kg, a maximum loading at the contact surface of 111 kg/mm2; and a proportionality constant of 3.20) The dynamic coefficient of friction is calculated using the equation:

$$f\,(\text{dynamic coefficient of friction}) = C \cdot \frac{AO - An}{n}$$

n: number of swings

AO: initial swing amplitude (AO in the standard test=0.5 radians)

An: angle of swing (radians) at the n-th swing

C: proportionality constant (C in the standard test=3.2)

Cold-Resistance Test

The running torque (expressed in g. cm) was measured at 25° C. and −45° C. by the method described in ASTM Test Method D-1478, where ASTM is the American Society for Testing of Materials.

Reference Example 1

To a chlorodimethylsiloxy-terminated dimethylsiloxane oligomer exhibiting a degree of polymerization of from 4 to 8 were added 1) a quantity of p-anilinophenol such that the number of moles of phenol were equal to the number of mole of chlorine present in the dimethylsiloxane oligomer, 2) a quantity of pyridine equal to the theoretical number of moles of hydrogen chloride generated as a by-product of the reaction of the phenol with the oligomer and 3) a quantity of toluene sufficient to solubilized the reactants. Heating and filtration of the reaction mixture followed by removal of volatile materials yielded a polyorganosiloxane with the following average formula, referred to hereinafter as ingredient B1.

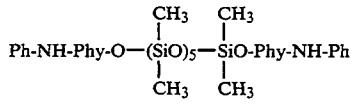

B1

Ph represents the phenyl radical and Phy represents the p-phenylene radical.

EXAMPLE 1

A fluorosilicone lubricant of the present invention was prepared by mixing the following ingredients to homogeneity for 2 hours at room temperature: 0.5 weight parts of ingredient B1 prepared as described in Reference Example 1 and 100 weight parts of a fluorosilicone oil with a viscosity of 700 centipoise (0.7 Pa.s) and the average formula

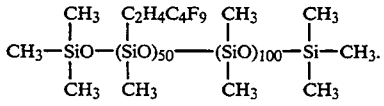

The tests to determine heat-resistance and lubrication were conducted on this fluorosilicone lubricant, and the results are reported in Table 1.

Reference Example 2

A cohydrolyzate was prepared by dripping into water the mixture of (1) a dichlorosilane with the formula $$C_4F_9C_2H_4Si\,(CH_3)\,Cl_2,$$

(2) dimethyldichlorosilane, and (3) trimethylchlorosilane in a molar ratio 1:1:0.2, respectively. 0.9 g potassium hydroxide was added to 60 g of this cohydrolyzate, and a reaction was run using azeotropic dehydration to remove the water and heptane as the organic liquid. 1.3 g. of anhydrous cerium chloride as a 25 weight percent solution in n-butanol was then dripped in with stirring. Filtration of the reaction mixture followed by removal of the solvent and a second filtration yielded a light-yellow liquid product (Ingredient B2).

EXAMPLE 2

A fluorosilicone lubricant of this invention was prepared by mixing the following ingredients for 2 hours at room temperature: 0.5 weight parts of ingredient B2, prepared as described in Reference Example 2 and 100 weight parts of a fluorosilicone oil exhibiting a viscosity of 700 centipoise (0.7 Pa.s). The fluorosilicone oil was composed of 60 weight parts of a diorganopolysiloxane with the average formula

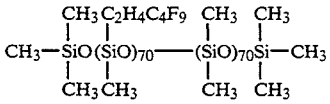

and 40 weight parts of a cyclic organosiloxane with the average formula

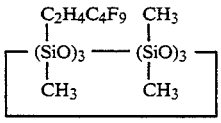

The previously described heat-resistance and lubrication tests were conducted on this fluorosilicone lubricant, and the results are reported in Table 1.

EXAMPLE 3

A fluorosilicone lubricant of this invention was prepared by mixing the following ingredients for 2 hours at room temperature: 0.5 weight parts of ingredient B2 prepared as described in Reference Example 2 and 100 weight parts of a fluorosilicone oil exhibiting a viscosity of 750 centipoise (0.75 Pa.s) and containing 70 weight parts of a diorganopolysiloxane with the average formula

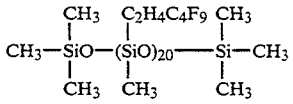

and 30 weight parts of a cyclic diorganosiloxane with the average formula

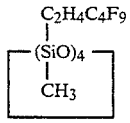

The heat-resistance and lubrication tests described in a preceding section of this specification were conducted on this fluorosilicone lubricant, and the results are reported in Table 1.

EXAMPLE 4

A fluorosilicone lubricant of the present invention was prepared by mixing the following ingredients for 2 hours at room temperature: 0.5 weight part of ingredient B2 prepared as described in Reference Example 2 and 100 weight parts of a fluorosilicone oil exhibiting a viscosity of 100 centipoise (0.1 Pa.s) and the average formula

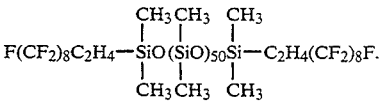

The heat-resistance and lubrication tests described in a preceding section of this specification were conducted on this fluorosilicone lubricant, and the results are reported in Table 1.

EXAMPLE 5

A fluorosilicone lubricant of this invention was prepared by mixing the following ingredients for 2 hours at room temperature: 0.5 weight parts ingredient B2 prepared as described in Reference Example 2 and 100 weight parts of a fluorosilicone oil exhibiting a viscosity of 750 centipoise (0.75 Pa.s) and the average formula.

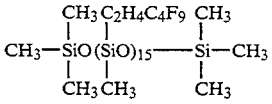

The previously described heat-resistance and lubrication tests were conducted on this fluorosilicone lubricant, and the results are reported in Table 1.

Comparison Example 1

A fluorosilicone lubricant outside the scope of this invention was prepared by mixing the following ingredients for 2 hours at room temperature: 0.5 weight parts of ingredient A, prepared as described in Reference Example 1 and 100 weight parts of a fluorosilicone oil exhibiting a viscosity of 400 centipoise (0.4 Pa.s) and the average formula

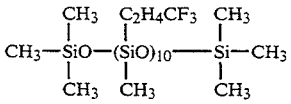

Gelation of the composition occurred prior to 100 hours when the heat resistance of this fluorosilicone lubricant was evaluated.

Comparison Example 2

A fluorosilicone oil exhibiting a viscosity of 700 centipoise (0.7 Pa.s) with the average formula

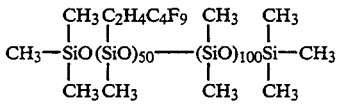

was subjected by itself to the heat-resistance test. The composition gelled in less than 100 hours.

TABLE 1

| | Example | | | | |
|---|---|---|---|---|---|
| | 1 | 2 | 3 | 4 | 5 |
| dynamic coefficient of friction (f) | 0.15 | 0.14 | 0.13 | 0.17 | 0.13 |
| change in viscosity following heat-resistance test (%) | | | | | |
| after 100 hours | 13 | 24 | 25 | 10 | 26 |
| after 200 hours | 16 | 25 | 32 | 13 | 35 |

EXAMPLE 6

A homogeneous fluorosilicone grease of this invention was prepared by mixing the following ingredients for 2 hours at room temperature: 50 weight parts of a powdered polytetrafluoroethylene resin exhibiting an average particle size of 3 micrometers and 100 weight parts of a fluorosilicone oil exhibiting a viscosity of 750 centipoise (0.75 Pa.s) and the average formula

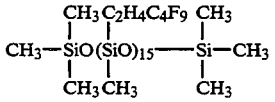

The cold-resistance and lubrication (dynamic coefficient of friction) tests were run on this fluorosilicone lubricant, and the results are reported in Table 2.

EXAMPLE 7

A homogeneous fluorosilicone lubricant grease was prepared by blending for 2 hours at room temperature 60 weight parts of the powdered polytetrafluoroethylene resin described in Example 6 and 100 weight parts of a fluorosilicone oil exhibiting a viscosity of 100 centipoise (0.1 Pa.s) and the average formula

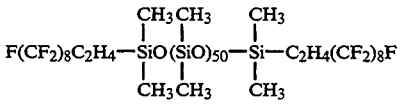

The previously described cold-resistance and lubrication tests were conducted on this fluorosilicone lubricant, and the results are reported in Table 2.

EXAMPLE 8

A homogeneous fluorosilicone lubricant grease was prepared by mixing the following ingredients for 2 hours at room temperature: 60 weight parts of a powdered perfluoroalkyloxytrifluoroethylene-containing polytetrafluoroethylene resin having an average particle size of 5 micrometers, 50 weight parts fluorosilicone oil exhibiting a viscosity of 750 centipoise (0.75 Pa.s) and the average formula

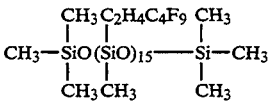

and 50 weight parts of a cyclic fluorosilicone oil exhibiting a viscosity 100 centipoise (0.1 Pa.s) and the average formula.

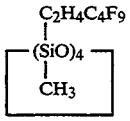

The previously described cold-resistance and lubrication tests were conducted on this fluorosilicone lubricant, and the results are reported in Table 2.

EXAMPLE 9

A homogeneous fluorosilicone lubricant grease was prepared by mixing the following ingredients for 2 hours at room temperature: 55 weight parts of a powdered polytetrafluoroethylene resin exhibiting an average particle size of 3 micrometers and 100 weight parts of a fluorosilicone oil exhibiting a viscosity of 700 centipoise (0.7 Pa.s) and the average formula

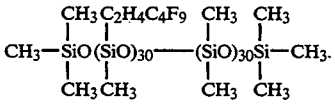

The previously described cold-resistance and lubrication tests were conducted on this fluorosilicone grease, and the results are reported in Table 2.

EXAMPLE 10

A homogeneous fluorosilicone lubricant grease was prepared by mixing the following ingredients for 2 hours at room temperature: 55 weight parts of a powdered polytetrafluoroethylene resin with an average particle size of 3 micrometers and 100 weight parts of a fluorosilicone oil exhibiting a viscosity of 700 centipoise (0.7 Pa.s) and composed of 60 weight parts of a fluorosilicone oil with the average formula

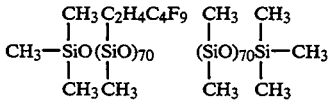

and 40 weight parts of a fluorosilicone oil with the average formula

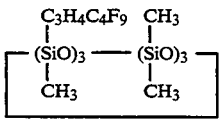

The previously described cold-resistance and lubrication tests were conducted on this fluorosilicone grease, and the results are reported in Table 2.

Comparison Example 3

A homogeneous fluorosilicone lubricant grease that is not of the present invention was prepared by mixing the following for 2 hours at room temperature: 50 weight parts of a powdered polytetrafluoroethylene resin with an average particle size of 3 micrometers and 100 weight parts of a fluorosilicone oil exhibiting a viscosity of 1,200 centipoise (1.2 Pa.s) and the average formula

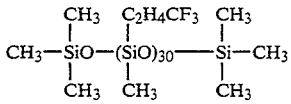

The previously described cold-resistance and lubrication tests were conducted on this fluorosilicone lubricant, and the results are reported in Table 2.

TABLE 2

| | Example 6 | Example 7 | Example 8 | Example 9 | Example 10 | Comp. Ex. 3 |
|---|---|---|---|---|---|---|
| dynamic coefficient of friction (f) | 0.11 | 0.13 | 0.11 | 0.14 | 0.13 | 0.16 |
| torque (g · cm) | | | | | | |
| 25° C. | ≦500 | ≦500 | ≦500 | ≦500 | ≦500 | ≦500 |
| −45° C. | 3000 | 2000 | 2500 | 1000 | 1000 | 6000 |

Comp. Ex. = Comparison Example

That which is claimed is:

1. A fluorosilicone lubricant composition comprising (A) 100 parts by weight of a fluorosilicone oil exhibiting a general formula selected from the group consisting of

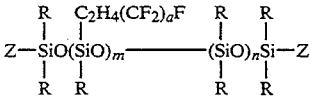

-continued

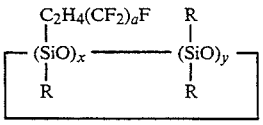

where R represents a monovalent hydrocarbon radical, Z represents a monovalent hydrocarbon radical or a perfluoroalkylethyl radical with the general formula $-C_2H_4(CF_2)_aF$, a is an integer with a value of at least 4, m is zero or a positive integer, n is zero or a positive integer, and the sum of m+n is from zero to 1,000, with the proviso that when m is zero, at least one of the Z groups represents said perfluoroalkylethyl radical, x is a positive integer, y is zero or a positive integer, and the sum of x+y is at least 3; and (B) as a heat stabilizer, 0.01 to 10 weight parts of a compound selected from the group consisting of 1) reaction products of a cerium compound and an alkali metal silanolate containing at least three organosiloxane units, and (2) organopolysiloxanes containing in each molecule at least one anilinophenoxy or naphthylaminophenoxy group.

2. A lubricant composition according to claim 1 where R represents an alkyl radical, the value of a is from 4 to 8, the viscosity of said fluorosilicone oil is from 10 to 100 centipoise, said cerium compound is selected from the group consisting of crystalline cerium chloride heptahydrate, cerium chloride decahydrate, high-purity cerium chloride, cerium fluoride, cerium oxalate, cerium acetate, cerium 2-ethylhexanoate, cerium naphthenate, and cerium acetylacetonate, and said organopolysiloxanes are linear.

3. A lubricant composition according to claim 2 wherein R is methyl, a is 4 or 8 and said cerium compound is cerium chloride heptahydrate.

* * * * *